US005823748A

United States Patent [19]

Benckert et al.

[11] Patent Number: 5,823,748

[45] Date of Patent: Oct. 20, 1998

[54] DEVICE FOR OPENING AND CLOSING A CLOSURE CAP

[75] Inventors: Hartmut Benckert, Filderstadt; Hellmut Hurr, Reutlingen; Paul Baeumen, Sindelfingen, all of Germany

[73] Assignee: Putzmeister-Werk Maschinenfabrik GmbH, Aichtal, Germany

[21] Appl. No.: 596,277

[22] PCT Filed: Aug. 5, 1994

[86] PCT No.: PCT/EP94/02603

§ 371 Date: Feb. 8, 1996

§ 102(e) Date: Feb. 8, 1996

[87] PCT Pub. No.: WO95/05538

PCT Pub. Date: Feb. 23, 1995

[30] Foreign Application Priority Data

Aug. 13, 1993 [DE] Germany ..... 43 27 177.4

[51] Int. Cl.[6] ..... F04B 49/00

[52] U.S. Cl. ..... 417/305; 417/440; 417/900; 251/58; 60/481

[58] Field of Search ..... 417/305, 434, 417/440, 516, 532, 900; 251/58; 60/481

[56] References Cited

U.S. PATENT DOCUMENTS

| | | | |
|---|---|---|---|
| 2,600,499 | 6/1952 | Harrower . | |
| 4,178,142 | 12/1979 | Schwing | 417/900 |
| 4,466,782 | 8/1984 | Hirashima et al. | 417/900 |
| 4,563,135 | 1/1986 | Riker | 417/517 |
| 4,681,022 | 7/1987 | Schwing | 417/532 |
| 4,979,884 | 12/1990 | Letarte et al. | 417/532 |

FOREIGN PATENT DOCUMENTS

| | | |
|---|---|---|
| 0 809 291 | 5/1951 | Germany . |
| 2 547 639 | 4/1977 | Germany . |
| 2 943 967 | 5/1981 | Germany . |
| 3538404 | 4/1987 | Germany . |
| 3 826 909 | 2/1989 | Germany . |
| 3 813 758 | 11/1989 | Germany . |
| 0 657 181 | 8/1986 | Switzerland . |

OTHER PUBLICATIONS

Putzmeister Betonfoerderleitungs–Programm PM Putzmeister–Werk Maschinenfabrik GmbH Mar. 1978; pp. 2–7.

*Primary Examiner*—Charles G. Freay
*Attorney, Agent, or Firm*—Flynn, Thiel, Boutell & Tanis, P.C.

[57] ABSTRACT

The invention concerns a device for opening and closing a closure cap (16) fitted over a cleaning aperture (10) in the floor of the discharge container (12) of a pump (14) for thick-bodies fluids. The cap (16) is linked to a hydraulic drive unit (20) and can be swung out hydraulically, when a control valve (48) is actuated, into the open position in which the discharge outlet is left open. The cap (16) is swung back into the closed position by means of a hand-operated lever (23), the hydraulic drive unit (20) being returned at the same time to its initial position.

14 Claims, 2 Drawing Sheets

DEVICE FOR OPENING AND CLOSING A CLOSURE CAP

FIELD OF THE INVENTION

The invention relates to a device for opening and closing a closure cap arranged on a bottom-side cleaning opening of a container, in particular, a material-feeding container for thick-matter pumps.

BACKGROUND OF THE INVENTION

In a conventional arrangement of this type, the closure cap is arranged on a container-fixed hinge joint, can be opened for emptying and cleaning of the feeding container of a concrete pump, and closed manually by swivelling. Increased frictional resistances occur, in particular during the opening operation, due to material adhering to the closure cap. These frictional resistances make the manual operation of the closure cap more difficult.

In order to make the operation easier, it would be possible to provide a hydraulic device for opening and closing of the closure cap. However, one must thereby consider that in such devices injury to an operator must be prevented through suitable safety measures. This, as a rule, requires additional equipment and related increased expense.

SUMMARY OF THE INVENTION

Starting out from this, the basic purpose of the invention is to provide a simple arrangement of the above-identified type, with which a closure cap on a container, as for example a material-feeding container of a thick-matter pump, can be opened and closed by one operator with little effort and without any danger of injury.

The invention is based on the thought that during the hydraulic opening of the closure cap, a danger of injury is essentially eliminated and that vice versa during closing of the closure cap, when the container is empty and has been cleaned, the manual closing does not require any particular strength. Accordingly, the invention suggests a hydraulic drive unit, which can be moved between an output and an end position and is coupled to the closure cap, for adjusting the closure cap between a closing position sealing off the cleaning opening and an outlet position at least partially releasing the cleaning opening, whereby the closure cap can be adjusted into its outlet position by operating a hydraulic correcting element controlling the pressure oil supply to the hydraulic drive unit and can be manually returned into its closing position by means of a mechanical control member with a simultaneous return of the hydraulic drive unit into its initial position.

The hydraulic drive unit has according to a preferred embodiment of the invention a drive piston, which can be moved in a one-way operating hydraulic cylinder, which can be loaded on the bottom side with pressurized oil and is connected on the rod side to an oil tank or to the atmosphere.

The feeding movement of the drive piston can be converted in a container-fixed hydraulic cylinder through a linkage connected to the piston rod into a pivoting movement of the closure cap. The drive piston can, as an alternative, be coupled through a rocking lever hinged on the piston rod to the closure cap, whereby the hydraulic cylinder in this case is pivotally arranged about an axis parallel to the axis of the cleaning opening on the container.

For the manual closing of the closure cap, the mechanical control member can be constructed as a handle or hand lever connected rigidly to the piston rod or to the closure lid.

The hydraulic supply to the hydraulic cylinder is advantageously controlled by a control valve designed as a 3/2-directional valve, whereby the bottom side of the hydraulic cylinder is connected, in a preferably manually operated switching position of the directional valve, to the pressure-oil supply and in the spring-centered rest position of the directional valve to the oil tank. Thus an incorrect handling of the hydraulic drive unit is essentially eliminated. At the same time, it is assured that the pressurized oil can, without any further measures, be removed from the bottom area of the driving cylinder upon operation of the mechanical control member and thus the hydraulic piston can be returned into its initial position.

For the measured discharge of the goods existing in the container, it is possible to control the opening speed of the closure cap with a flow valve preferably designed as a regulatable throttle valve to influence the pressurized oil supply to the hydraulic drive unit.

To limit the closing movement and the liquid-tight sealing of the cleaning opening, the closure lid is advantageously pressed through an abutting slope of a stop piece arranged on the container bottom in its closing position against a sealing ring.

BRIEF DESCRIPTION OF DRAWINGS

The invention will be discussed in greater detail hereinafter in connection with the exemplary embodiments schematically illustrated in the drawings, in which.

DETAILED DESCRIPTION

Figure 1:
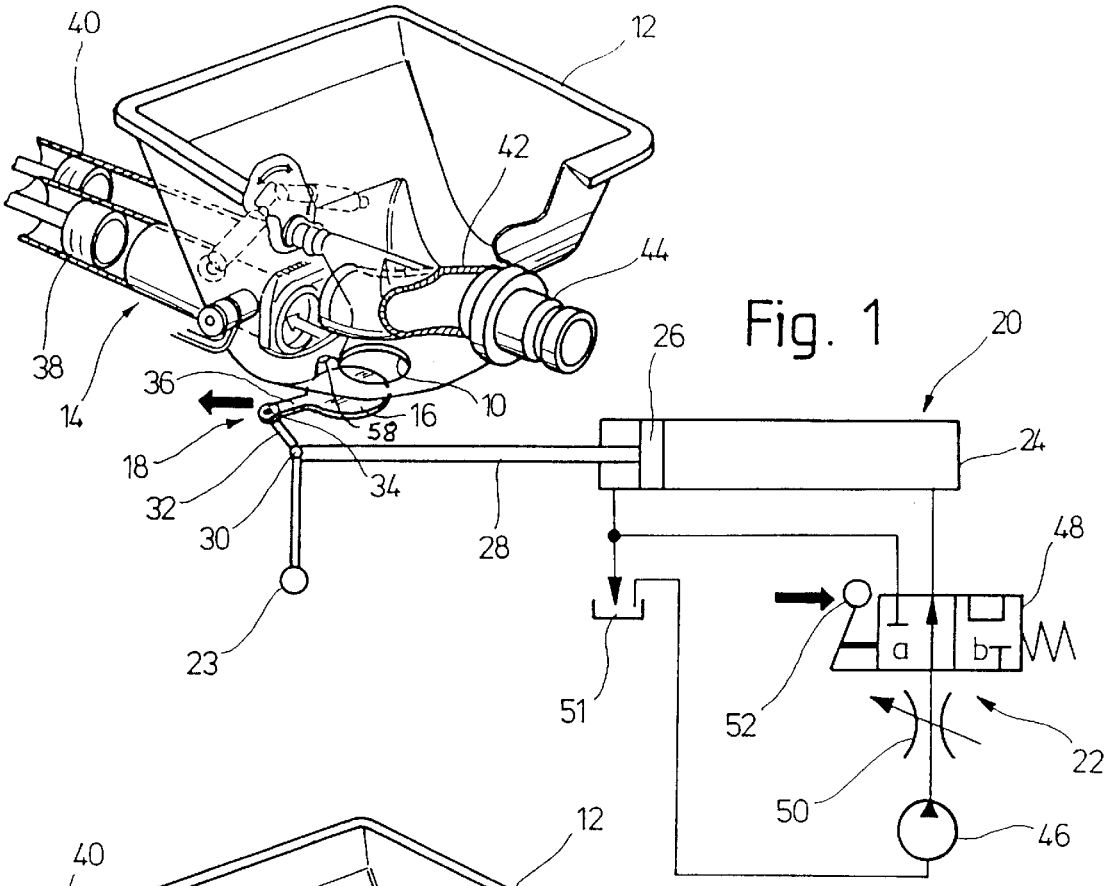
FIGS. 1 and 2 are partially diagrammatic views of an arrangement for closing a cleaning opening of a container with the closure cap being open and closed.

The closure arrangements illustrated in the drawings consist essentially of a closure cap 16 arranged on a bottom-side cleaning opening 10 of a container 12 of a thick-matter pump 14. The cap is coupled to a hydraulic drive unit 20, whereby the closure cap can be hydraulically opened after the release of a hydraulic correcting element 22 and can again be closed liquid-tight by operating a mechanical control member designed as a hand lever 23.

Figure 2:
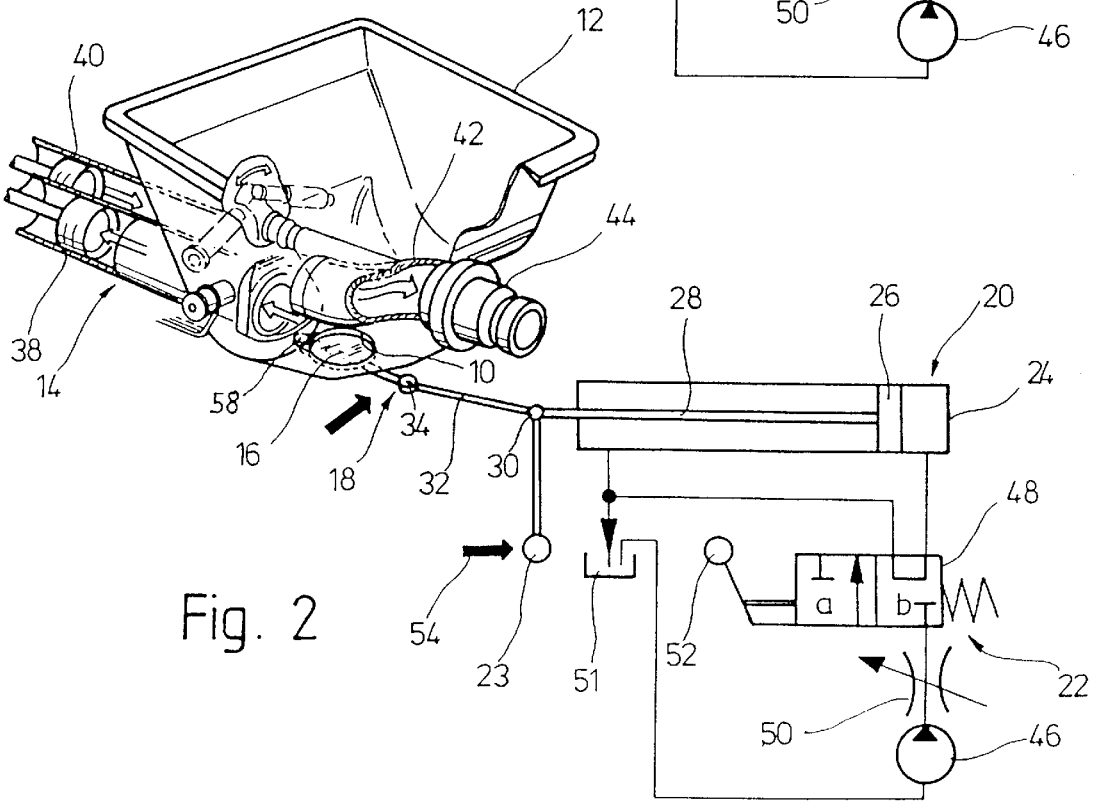

The hydraulic drive unit 20 has a drive piston 26 movable in a one-way acting hydraulic cylinder 24, which piston in the exemplary embodiment according to FIGS. 1 and 2 is coupled with the closure cap 16 through its piston rod 28 and a linkage 18 consisting of two coupling members 32, 36 connected through hinge joints 30, 34 to the piston rod 28 and to one another. The cap in turn is arranged pivotally about an axis 58, which is parallel to the axis of the cleaning opening 10, on the outside bottom of the container.

The cleaning opening 10 is, during the operation of the thick-matter pump 14, closed off liquid-tight by the closure cap 16, which is in its closing position. To convey the material fed into the container 12, the thick-matter pump 14 has two conveyor cylinders 38, 40, the front-side openings of which end in the container 12 and are during the pressure stroke alternately connected through a swivel pipe 42 to a feed pipeline 44.

The closure cap 16 is hydraulically opened in order to empty out the residual material in the container 12 (FIG. 1). The hydraulic correcting element 22, which is arranged between the bottom connection of the hydraulic cylinder 24 and the pressure side of a pump 46, and which consists of a 3/2(three port, two position)-directional valve 48 and a regulatable throttle valve 50 connected in front of the directional valve 48, is for this purpose operated. The directional valve 48, which is manually operated by means of a release member 52, connects in its switching position a the bottom end of the hydraulic cylinder 24 to the pressurized oil supply, which causes the piston 26 to be moved thereby swivelling the closure cap 16 into its opened position exposing the cleaning opening 10. The rod side of the hydraulic cylinder 24 is thereby either, as illustrated, connected to an oil tank 51, or, however, is directly relieved to the atmosphere. In order to measure the outflow of the goods out of the cleaning opening 10, it is possible to control its opening speed with a regulated throttling of the pressure-oil supply through the throttle valve 50.

When letting go of the release member 52, the directional valve 48 returns into its spring-centered rest position b, in which it connects the bottom end of the hydraulic cylinder 24 to the oil tank 51 (FIG. 2). The closure cap 16 can in this position after the container 12 has been emptied be swung back into its closing position by means of the hand lever 23 rigidly arranged on the piston rod 28. The hand lever 23 is for this purpose pressed in direction of the arrow 54 with a simultaneous return of the piston 26 into its initial position, whereby the pressurized oil flows from the bottom side back to the rod side of the hydraulic cylinder 24 or into the tank 51.

Figure 3:
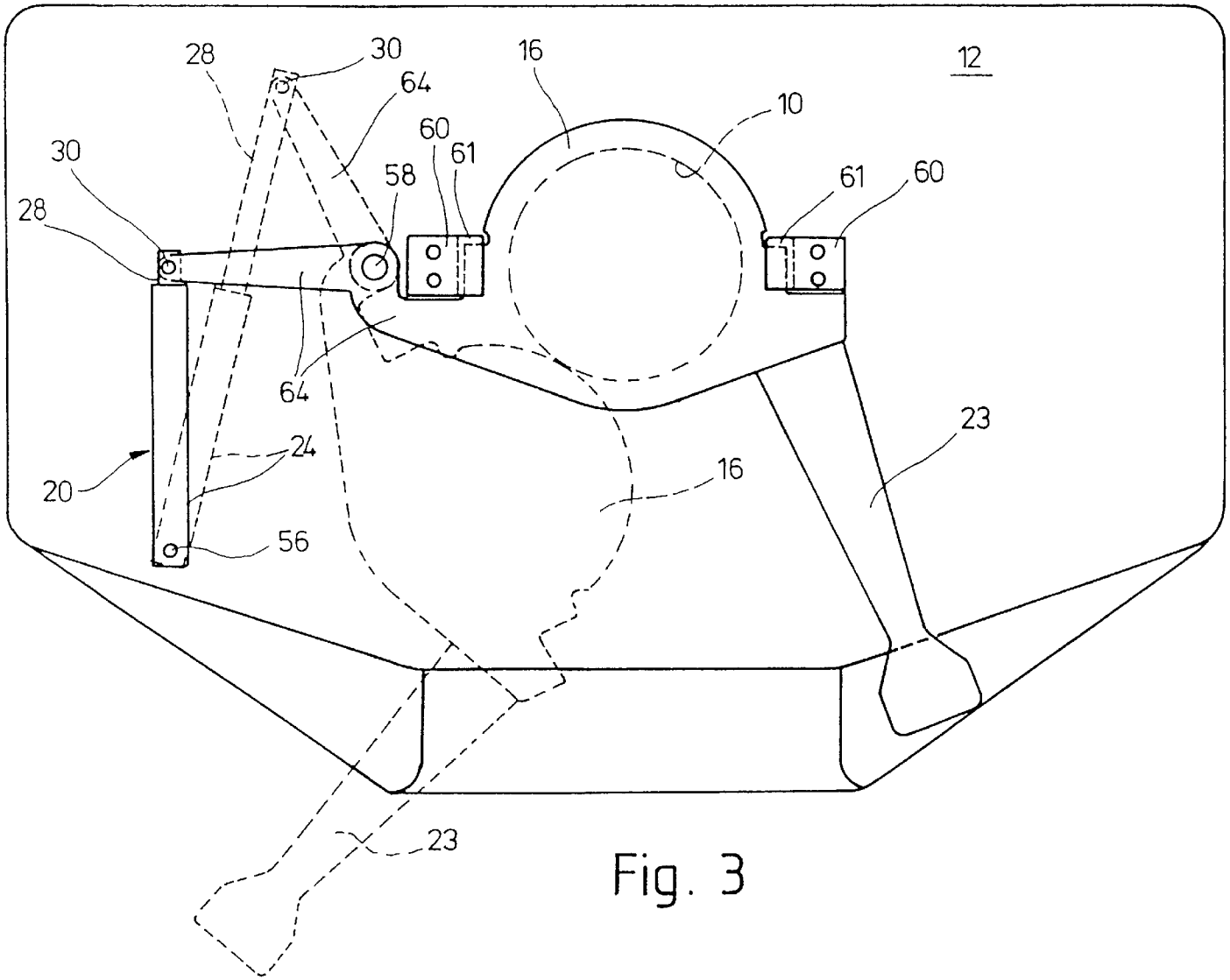
FIG. 3 is a bottom view of a further modification of a closure arrangement in a closed (full lines) and an open (dashed lines) position.

FIG. 3 shows a modified exemplary embodiment of a closure arrangement, in which the same parts have been identified with the same reference numerals. The hydraulic cylinder 24 is, in this embodiment, arranged pivotally about a container-fixed axis 56 on the bottom of the container and the piston rod is connected to the closure lid 16 through a rocking lever 64, which is rotatable about the container-fixed axis 58, whereby the pivot axes 56, 58 and the axis of the hinge joint 30 are arranged parallel to the axis of the cleaning opening 10. The closure lid 16 can be swung by means of the hydraulical drive unit 20 in the already described manner hydraulically into its outlet position and can be swung back into its closing position against the stop pieces 60 by means of the hand lever 23, which is rigidly connected to the closure lid 16. The closure lid 16 grips thereby under an abutting slope 61 constructed on the stop pieces 60, and is thus in its closing position pressed against a sealing ring, which seals liquid-tight the cleaning opening 10.

Closure devices of the invention can, aside from the above-mentioned uses, also be used on other feed and storage containers and on premixing troughs.

In summary the following can be stated: The invention relates to a device for opening and closing of a closure cap 16 arranged on a bottom-side cleaning opening 10 of a material-feeding container 12 of a thick-matter pump 14. The closure cap 16 coupled with the hydraulic drive unit 20 can be swung out hydraulically into its outlet position releasing the cleaning opening 10 by operating a control valve 48. The swinging back of the closure cap 16 into its closing position is done manually by means of a mechanical control member 23 with a simultaneous return of the hydraulic drive unit 20 into its initial position.

The embodiments of the invention in which an exclusive property or privilege is claimed are defined as follows:

1. A device for opening and closing a closure cap arranged on a bottom-side cleaning opening of a container, comprising a pump generating a fluid pressure supply, a hydraulic drive unit, movable between initial and end positions and being coupled with the closure cap for only adjusting the closure cap from a closed position sealing off the cleaning opening when said drive unit is at said initial position to an open position at least partially exposing the cleaning opening when said drive unit is at said end position, a hydraulic correcting element fluidly connected to the hydraulic drive unit for controlling the pressure supply to the hydraulic drive unit to effect a hydraulic powered movement of the closure cap into the open position and an unpowered movement of the closure cap to the closed position, and a control means for manually simultaneously moving the closure cap to the closed position and the hydraulic drive unit to the initial position.

2. The device according to claim 1, wherein the hydraulic drive unit has a drive piston, and a one-way operating hydraulic cylinder movably receiving the drive piston therein, the drive piston defining a bottom side and rod side in the hydraulic cylinder, the hydraulic cylinder being loaded with pressurized fluid on the bottom side and is connected on the rod side to one of a fluid tank and the atmosphere.

3. The device according to claim 2, wherein the drive piston includes a rod, and a linkage connects the closure cap to the rod.

4. The device according to claim 3, wherein the control means is one of a handle and hand lever rigidly connected to one of the rod and the closure cap.

5. The device according to claim 2, wherein the drive piston includes a rod, and wherein a rocking lever is coupled to the closure cap while simultaneously being hinged to the rod.

6. The device according to claim 5, wherein the hydraulic cylinder is pivotal about a container-fixed axis, the container-fixed axis being parallel to an axis of the cleaning opening.

7. The device according to claim 1, wherein the closure cap is pivotally fixed to the container and is pivotal about an axis parallel to the axis of the cleaning opening.

8. The device according to claim 2, wherein the hydraulic correcting element is a control valve designed as a 3/2 directional valve.

9. The device according to claim 8, wherein the bottom side of the hydraulic cylinder is connected to the control valve, and the control valve in a manually operated switching condition thereof connecting the bottom side to the pressure supply and in a resting condition thereof connecting the bottom side to a fluid tank.

10. The device according to claim 9, wherein a spring is provided for returning the control valve to the resting condition whereat the bottom side of the hydraulic cylinder is connected through the control valve to the fluid tank.

11. The device according to claim 1, wherein the hydraulic correcting element has a flow valve for regulating the pressure supply from the pump to the hydraulic drive unit.

12. The device according to claim 1, wherein a stop niece is arranged on the bottom of the container adjacent the cleaning opening, the stop piece having a slope thereon, and wherein a sealing ring surrounds the cleaning opening, the closure cap being pressed in the closed position against the sealing ring through the slope of the stop piece.

13. A device for opening and closing a cleaning opening of a material-feed container, comprising a closure lid adapted to be in first and second positions respectively closing and opening the cleaning opening, a pump generating a fluid pressure supply, a one-way acting drive cylinder being connected to the closure lid and selectively connected to the pump for receiving the fluid pressure supply, a hydraulic element being fluidly connected between the one-way acting drive cylinder and the pump for controlling the flow of the fluid pressure supply to the drive cylinder, the one-way acting drive cylinder effecting movement of the closure lid only to the second position when receiving the fluid pressure supply, and means for manually moving the closure lid into the first position.

14. The device according to claim 13, wherein the means for manually moving the closure lid also manually moves the drive cylinder to a position corresponding to a closed position of the closure lid.

* * * * *